US007018139B1

(12) United States Patent
Slemons

(10) Patent No.: US 7,018,139 B1
(45) Date of Patent: Mar. 28, 2006

(54) STRUCTURAL HELICAL PILE

(75) Inventor: Philip Erwin Slemons, Jonesboro, GA (US)

(73) Assignee: Cantsink, Inc., Lilburn, GA (US)

( * ) Notice: Subject to any disclaimer, the term of this patent is extended or adjusted under 35 U.S.C. 154(b) by 0 days.

(21) Appl. No.: 11/135,590

(22) Filed: May 23, 2005

(51) Int. Cl.
*E02D 5/56* (2006.01)

(52) U.S. Cl. ..... 405/253; 405/254; 405/252.1; 405/231

(58) Field of Classification Search ..... 405/252.1, 405/253, 254, 231
See application file for complete search history.

(56) References Cited

U.S. PATENT DOCUMENTS 5,575,122 A * 11/1996 Hamilton et al. ..... 405/253
6,352,391 B1 * 3/2002 Jones ..... 405/252.1
6,394,704 B1 * 5/2002 Saeki et al. ..... 405/252.1

FOREIGN PATENT DOCUMENTS

JP 2002-348864 * 12/2002

* cited by examiner

*Primary Examiner*—Frederick L. Lagman
(74) *Attorney, Agent, or Firm*—Needle & Rosenberg, P.C.

(57) ABSTRACT

A structural helical pile having an elongate shaft member defining a longitudinal axis. The structural helical pile also comprises a radially extending, generally helical load bearing member integral with the shaft member and projecting outwardly from the longitudinal axis of the shaft member. The helical load bearing member has a leading edge and a trailing edge. The respective leading and trailing edges intersect the shaft member in spaced relationship along the longitudinal length of the shaft member. The helical load bearing member further comprises at least one rib integrally formed therein. In this aspect, each rib extends outwardly from the longitudinal axis of the shaft member and has a substantially uniform cross-sectional thickness.

14 Claims, 4 Drawing Sheets

STRUCTURAL HELICAL PILE

FIELD OF THE INVENTION

The present invention relates to helical pile, more specifically to a structural helical pile with a reinforced helix.

BACKGROUND OF THE INVENTION

In the construction industry it is necessary to construct a building foundation on firm soil. When firm soil is unavailable, various pile systems are used to provide support from the hard pan soil that exists well below the soil surface to the foundation.

Generally, these pile systems use piles that can be directly drilled into the soil. Conventional piles have helical members that are shaped such that when the pile is rotated, it augers into the soil. The helical member also provides support for the pile and, under load, bears the load of the pile such that the pile is substantially fixed relative to the surrounding soil. The helix's diameter determines the amount of load that the pile will bear.

With higher loads and larger diameter helixes, the thickness of the helix becomes an issue. Generally, with higher diameter helixes it is necessary to increase the thickness of the helix in order to avoid flexing and eventual failure of helical members. Clearly, thicker helixes require more raw materials and, therefore, increased material cost. What is needed is a helix design that has the strength of a thicker helix, without the additional material cost.

SUMMARY

The present invention relates to a structural helical pile having an elongate shaft member defining a longitudinal axis. In one aspect, the structural helical pile also comprises a radially extending, generally helical load bearing member integral with the shaft member and projecting outwardly from the longitudinal axis of the shaft member. The helical load bearing member has a leading edge and a trailing edge. The respective leading and trailing edges intersect the shaft member in spaced relationship along the longitudinal length of the shaft member. The helical load bearing member further comprises at least one rib integrally formed therein. In this aspect, each rib extends outwardly from the longitudinal axis of the shaft member and has a substantially uniform cross-sectional thickness.

In another aspect, the invention is a method of manufacturing a structural helical pile. The method comprises providing an elongate shaft member defining a longitudinal axis and forming the aforementioned helical load bearing member. The method further comprises integrally mounting the helical load bearing member on the elongate shaft member such that the helical load bearing member projects outwardly from the longitudinal axis of the shaft member. In this aspect, the respective leading and trailing edges intersect the shaft member in spaced relationship along the longitudinal length of the shaft member.

BRIEF DESCRIPTION OF THE DRAWINGS

These and other features of the preferred embodiments of the present invention will become more apparent in the detailed description in which reference is made to the appended drawings wherein.

DETAILED DESCRIPTION OF THE INVENTION

Figure 1:
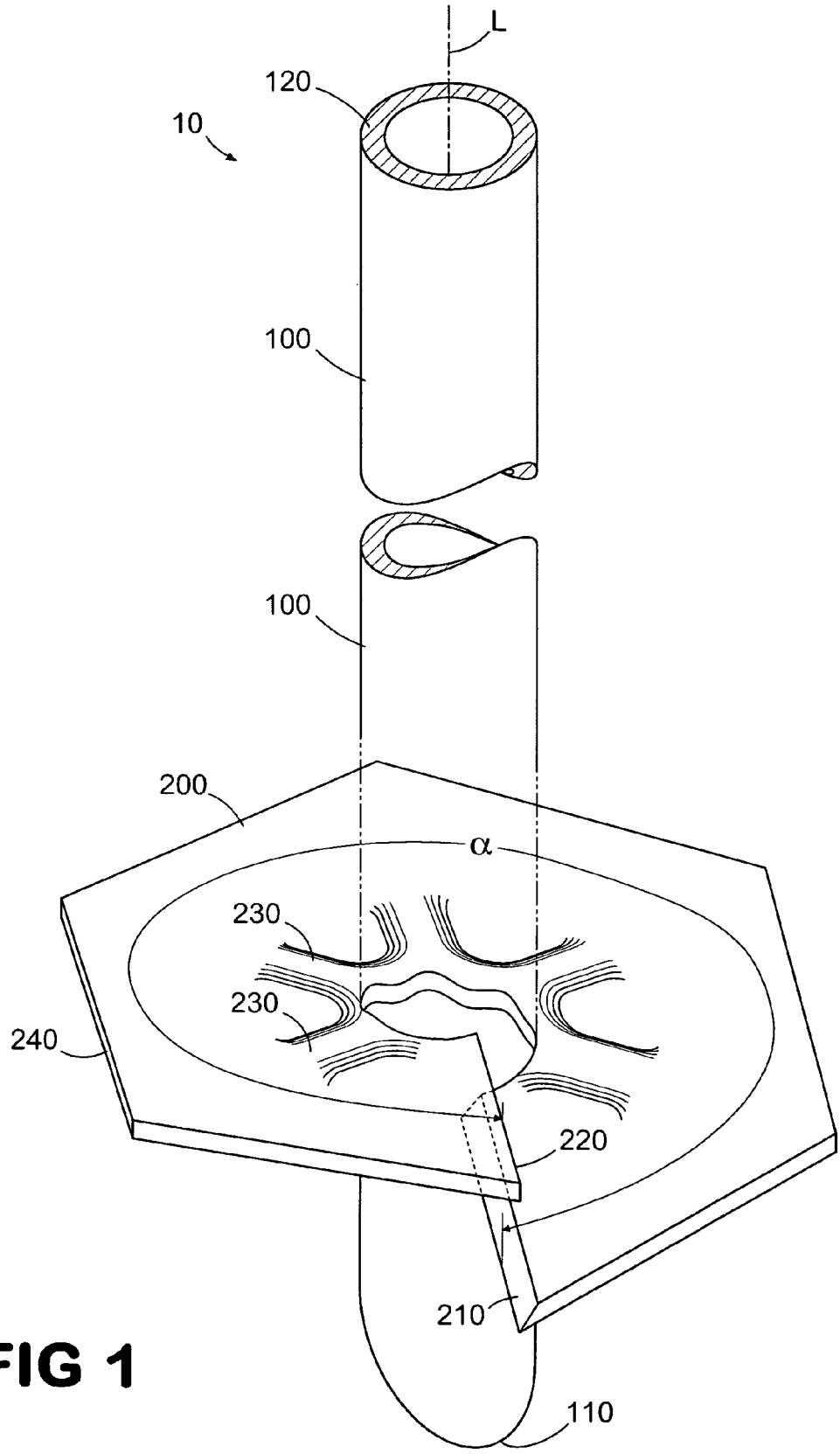
FIG. 1 is a perspective view of one aspect of the present invention for structural helical pile showing an elongate shaft member and a helical load bearing member attached thereto.
Figure 2:
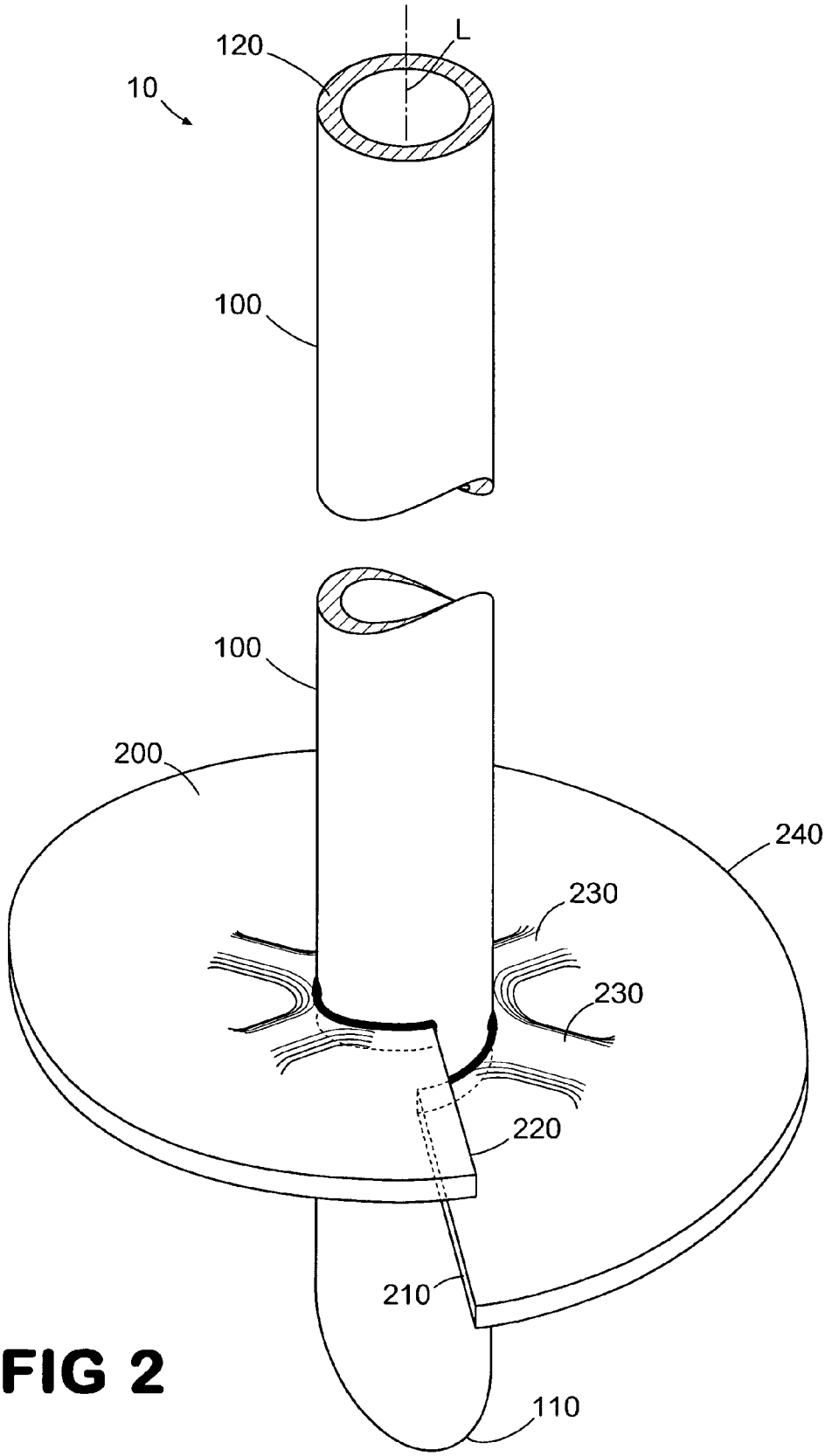
FIG. 2 is a perspective view of the structural helical pile of FIG. 1 showing a helical load bearing member with a generally circular shape.
Figure 3:
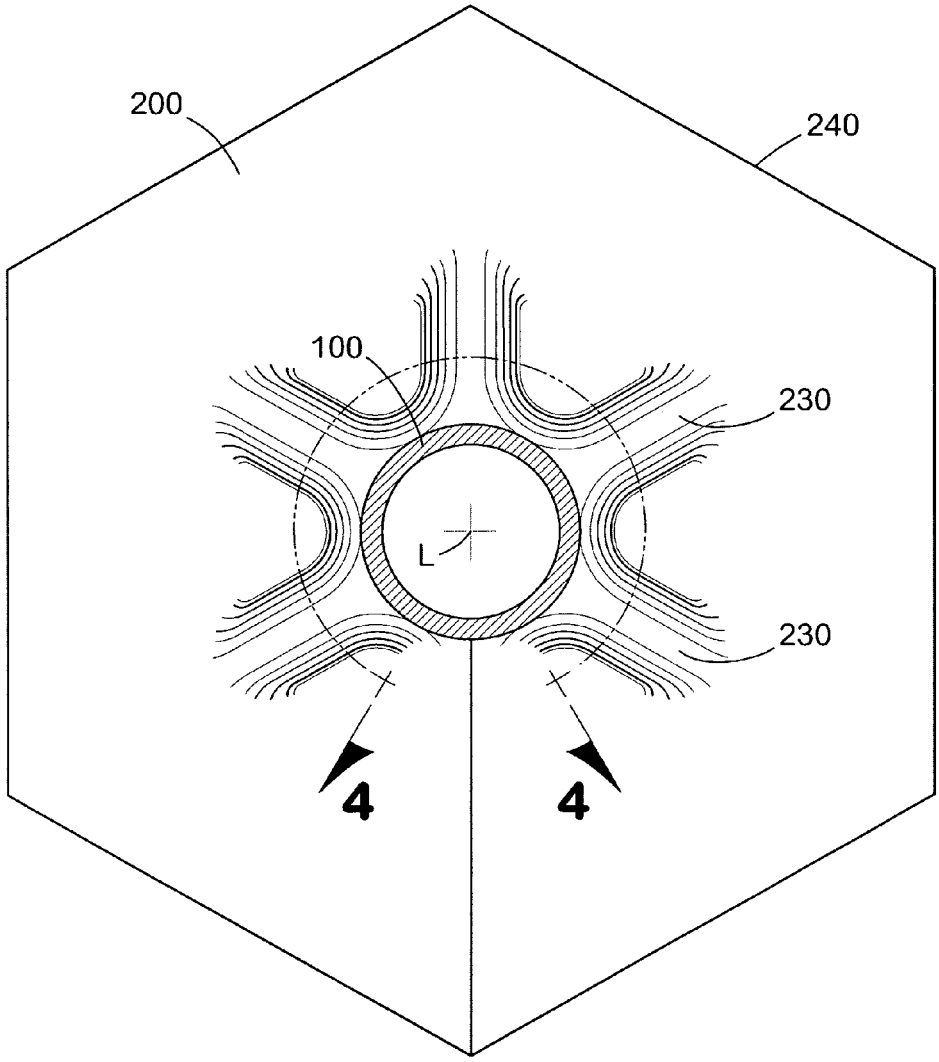
FIG. 3 is top plan view of the structural helical pile of FIG. 1.

The present invention is more particularly described in the following exemplary embodiments that are intended as illustrative only since numerous modifications and variations therein will be apparent to those skilled in the art. As used herein, "a," "an," or "the" can mean one or more, depending upon the context in which it is used. The preferred embodiments are now described with reference to the figures, in which like reference characters indicate like parts throughout the several views.

Ranges may be expressed herein as from "about" one particular value, and/or to "about" another particular value. When such a range is expressed, another embodiment includes from the one particular value and/or to the other particular value. Similarly, when values are expressed as approximations, by use of the antecedent "about," it will be understood that the particular value forms another embodiment.

In one aspect of the present invention for a structural helical pile 10, the invention comprises an elongate shaft member 100 defining a longitudinal axis L. The shaft member 100 has at least one radially extending, generally helical load bearing member 200 that is integral with the shaft member and projecting outwardly from the longitudinal axis L of the shaft member 100. The helical load bearing member 200 has a leading edge 210 and a trailing edge 220. The respective leading and trailing edges intersect the shaft member in a spaced relationship along the longitudinal length of the shaft member.

In one aspect, the helical load bearing member 200 comprises at least one rib 230 integrally formed therein, extending outwardly from the longitudinal axis of the shaft member 100. In this aspect, the helical load bearing member 200 has a substantially uniform cross-sectional thickness C.

In one aspect, each rib 230 extends substantially radially from the longitudinal axis of the shaft member. In another aspect, a portion of each rib is integral with the shaft member 100. In yet another aspect, a portion of each rib extends to an outermost edge 240 of the helical load bearing member. In one aspect, and not meant to be limiting, there are five ribs 230, however, as one will appreciate, any number of ribs is contemplated. Additionally, each rib 230 may be spaced substantially uniformly from an adjacent rib 230 or they may be spaced in any fashion at all.

The ribs 230 provide a reinforcing or stiffening effect on the helical load bearing member without adding any mass to the helical load bearing member itself or using any additional raw material. The ribs may be formed by stamping, or any other conventional means. One such conventional means comprises cutting a radial slit in the helical member for each rib, bending a portion of the helical load bearing member 200 to form a flap, and attaching the portion of the flap that is adjacent the shaft member to the exterior surface of the shaft member 100.

A similar result in increased helix strength could be achieved by welding ribs onto the exterior surface of the helical load bearing member 200. Alternatively, a smaller diameter helical load bearing member may be welded or otherwise attached to the interior portion of the exterior surface of the helical load bearing member. However, both of these options require additional materials. Forming the ribs integrally with the helical load bearing member without adding material has the result of adding the required strength while keeping the cost of the overall structural helical pile 10 down.

The leading edge 210 and the trailing edge 220 of the helical load bearing member 200 are spaced apart in spaced relationship along the longitudinal length of the shaft a predetermined distance P. In one aspect, the predetermined distance is between about 1.5" and 7.5". In another aspect, the leading edge 210 and the trailing edge 220 of the helical load bearing member 200 are spaced apart about 3". As can be appreciated by one skilled in the art, a 3" pitch is industry standard in residential and smaller commercial applications and a 6" pitch is industry standard in larger commercial applications. However, a pitch greater than or less than the industry standard is also contemplated.

Figure 4:
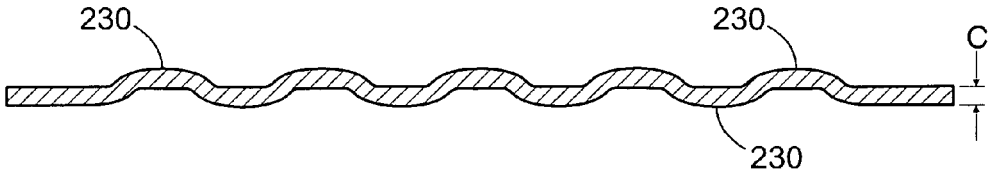
FIG. 4 is a side rolled-out cross-sectional view of the structural helical pile of FIG. 1 taken along line 4—4 of FIG. 3.
Figure 5:
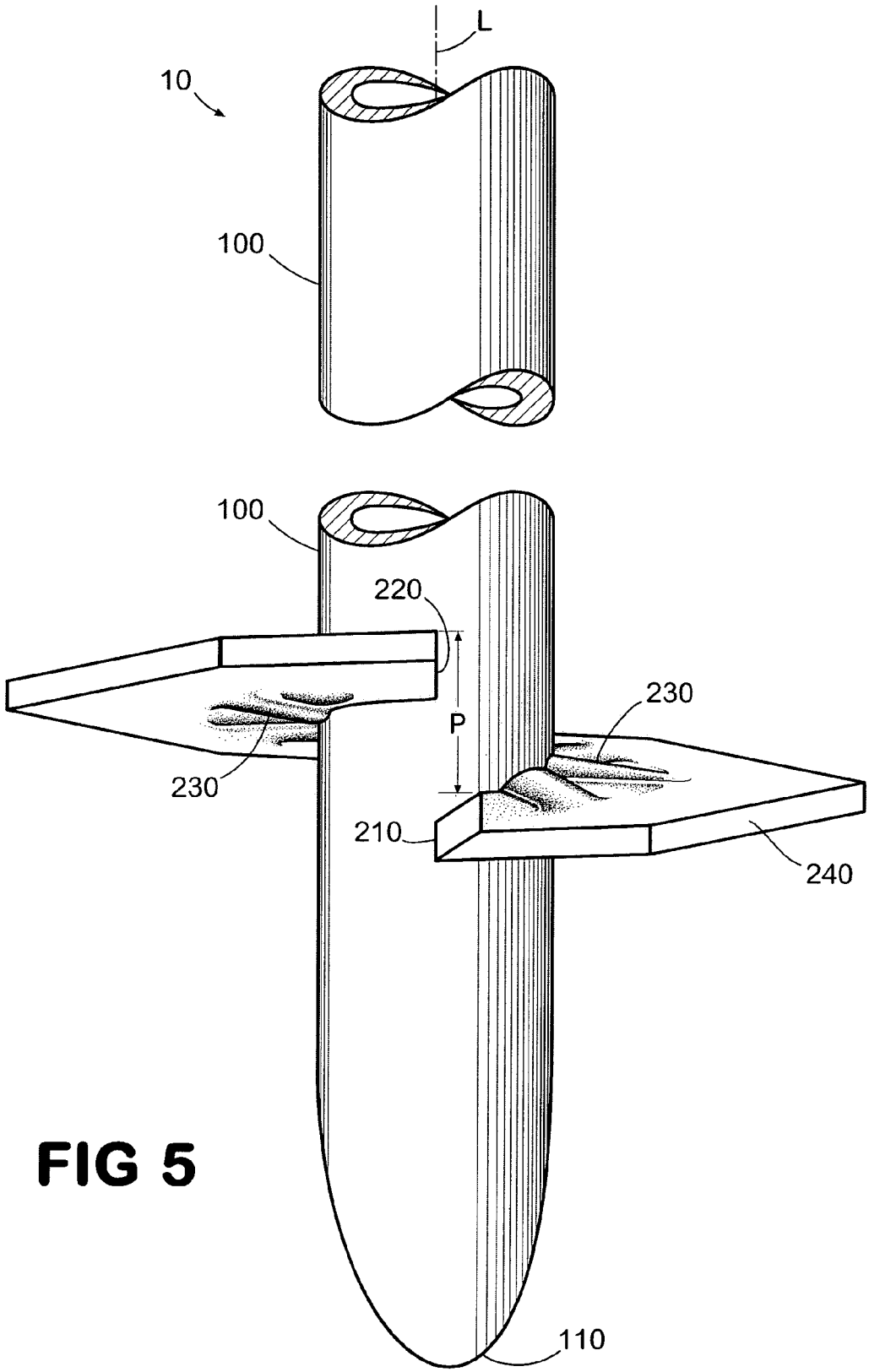
FIG. 5 is a side elevational view of the structural helical pile of FIG. 1.

In another aspect of the invention, as can be seen in FIG. 4, the helical load bearing member has a wave shape in a circumferential cross sectional dimension that extends through the plurality of ribs 230. This is accomplished by having the ribs extend upwardly away from the upper surface of the helical load bearing member 200 and downwardly away from the lower surface of the helical load bearing member, in an alternating fashion.

In one aspect, the leading edge 210 of the helical load bearing element is beveled to present a sharpened helix leading edge. Sometimes optionally sharpening the leading edge of the helical load bearing member 200 may be beneficial, especially in harder soils.

A portion of the leading edge 210 of the helical load bearing member may be spaced from a portion of the trailing edge a predetermined angle $\alpha$. In one aspect, a is from about 300 degrees to about 750 degrees. In another aspect, $\alpha$ is about 360 degrees. In yet another aspect, the respective leading and trailing edges of the helical load bearing member do not overlap in a direction longitudinally of the shaft member, that is the leading edge 210 and trailing edge 220 do not overlap in a plane that bisects the longitudinal axis L of the shaft member 100.

Although the helical load bearing member 200 may be positioned at any point thereon the shaft member 100, in one aspect, the helical load bearing member is positioned proximate the distal end 110 of the shaft member. In another aspect, the helical load bearing member is positioned intermediate the proximal 120 and distal 110 ends of the shaft member 100.

One embodiment of the invention is a method of manufacturing a structural helical pile 10. The method comprises providing an elongate shaft member defining a longitudinal axis L. Further, the method comprises forming a helical load bearing member having a leading edge, a trailing edge, and at least one rib 230 integrally formed therein. In one aspect, the helical load bearing member is formed by mechanically pressing a plate to bend the plate into the desired shape of the helical load bearing member 200. Each rib extends outwardly from an innermost edge of the helical load bearing member. In this aspect, the helical load bearing member has a substantially uniform cross-sectional thickness C. The method also comprises integrally mounting the helical load bearing member onto the elongate shaft member such that the helical load bearing member 200 projects outwardly from the longitudinal axis L of the shaft member. Here, the respective leading and trailing edges intersect the shaft member 100 in spaced relationship along the longitudinal length of the shaft member.

Although several embodiments of the invention have been disclosed in the foregoing specification, it is understood by those skilled in the art that many modifications and other embodiments of the invention will come to mind to which the invention pertains, having the benefit of the teaching presented in the foregoing description and associated drawings. It is thus understood that the invention is not limited to the specific embodiments disclosed herein above, and that many modifications and other embodiments are intended to be included within the scope of the appended claims. Moreover, although specific terms are employed herein, as well as in the claims which follow, they are used only in a generic and descriptive sense, and not for the purposes of limiting the described invention, nor the claims which follow.

What is claimed is:

1. A structural helical pile, comprising:

an elongate shaft member defining a longitudinal axis; and a radially extending, generally helical load bearing member integral with the shaft member and projecting outwardly from the longitudinal axis of the shaft member, said helical load bearing member having a leading edge and a trailing edge, wherein the respective leading and trailing edges intersect the shaft member in spaced relationship along said longitudinal length of the shaft member, wherein the helical load bearing member further comprises a plurality of ribs integrally formed therein, each rib extending outwardly from the longitudinal axis of the shaft member and being spaced substantially uniformly from an adjacent rib, and wherein the helical load bearing member has a substantially uniform cross-sectional thickness and a wave shape in a circumferential cross sectional dimension that extends through the plurality of ribs.

2. The structural helical pile of claim 1, wherein each rib extends substantially radially from the longitudinal axis of the shaft member.

3. The structural helical pile of claim 1 or 2, wherein a portion of each rib is integral with the shaft member.

4. The structural helical pile of claim 3, wherein a portion of each rib extends to an outermost edge of the helical load bearing member.

5. The structural helical pile of claim 1, wherein the plurality of ribs comprises five ribs.

6. The structural helical pile of claim 1, wherein the leading edge and the trailing edge of the helical load bearing member are spaced apart between about 1.5" and 7.5".

7. The structural helical pile of claim 1, wherein the leading edge and the trailing edge of the helical load bearing member are spaced apart about 3".

8. The structural helical pile of claim 1, wherein said leading edge of the helical load bearing element is beveled to present a sharpened helix leading edge.

9. The structural helical pile of claim 1, wherein a portion of the leading edge of the helical load bearing member is spaced from a portion of the trailing edge from about 300 degrees to about 750 degrees.

10. The structural helical pile of claim 1, wherein a portion of the leading edge of the helical load bearing member is spaced from a portion of the trailing edge about 360 degrees.

11. The structural helical pile of claim 1, wherein the respective leading and trailing edges of the helical load bearing member do not overlap in a direction longitudinally of the shaft member.

12. The structural helical pile of claim 1, wherein the shaft member has a distal end, and wherein the helical load bearing member is positioned proximate the distal end of the shaft member.

13. The structural helical pile of claim 1, wherein the shaft member has a proximal end and a distal end, and wherein the helical load bearing member is positioned intermediate the proximal and distal ends of the shaft member.

14. A method of manufacturing a structural helical pile, the method comprising:

providing an elongate shaft member defining a longitudinal axis;

forming a helical load bearing member, said helical load bearing member having a leading edge, a trailing edge, and a plurality of ribs integrally formed therein, each rib extending outwardly from an innermost edge of the helical load bearing member and being uniformly spaced from an adjacent rib, wherein the helical load bearing member has a substantially uniform cross-sectional thickness and a wave shape in a circumferential cross sectional dimension that extends through the plurality of ribs; and integrally mounting the helical load bearing member thereon the elongate shaft member such that the helical load bearing member projects outwardly from the longitudinal axis of the shaft member, wherein the respective leading and trailing edges intersect the shaft member in spaced relationship along said longitudinal length of the shaft member.

* * * * *